US007135646B2

(12) United States Patent
Tan

(10) Patent No.: US 7,135,646 B2
(45) Date of Patent: Nov. 14, 2006

(54) ELECTRICAL SWITCH

(75) Inventor: Shi-Jie Tan, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/397,431

(22) Filed: Apr. 3, 2006

(65) Prior Publication Data

US 2006/0219532 A1 Oct. 5, 2006

(30) Foreign Application Priority Data

Apr. 1, 2005 (TW) ..... 94205106 U

(51) Int. Cl.
*H01H 9/00* (2006.01)

(52) U.S. Cl. ..... 200/4; 200/14; 200/406

(58) Field of Classification Search ..... 200/4, 200/5 R, 14, 17 R, 18, 406; 341/20, 22, 341/35; 345/156, 157, 168, 169, 172, 184
See application file for complete search history.

(56) References Cited

U.S. PATENT DOCUMENTS 5,204,502 A * 4/1993 Ferris et al. ..... 200/4
6,236,002 B1 * 5/2001 Chou ..... 200/4
6,525,277 B1 * 2/2003 Oba et al. ..... 200/4
6,670,563 B1 * 12/2003 Jeon ..... 200/11 R
6,784,384 B1 * 8/2004 Park et al. ..... 200/11 R
6,952,197 B1 * 10/2005 Nakamura et al. ..... 345/157
6,974,921 B1 * 12/2005 Jørgensen et al. ..... 200/14

* cited by examiner

*Primary Examiner*—Michael A Friedhofer
(74) *Attorney, Agent, or Firm*—Wei Te Chung

(57) ABSTRACT

An electrical switch includes an insulative housing (10), a set of fixed contacts fastened in the housing, a movable contacts (30) received in the housing, a load plate (40) mounted above the movable contact, a spring (50) mounted in the load plate, a driver (60) defined on the load plate, a shell (70) surrounding the housing, a knob (80) assembled with the load plate, and a push button (90) assembled on the load plate. While rotating the knob, the load plate is accordingly rotated, and the movable contacts are driven to contact with some of the fixed contacts, which enables rotary operation. While pressing the push button, the driver is pressed to move downwardly to press the movable contacts for contacting with the fixed contacts, which enables pushing operation.

18 Claims, 20 Drawing Sheets

B-B

ELECTRICAL SWITCH

BACKGROUND OF THE INVENTION

1. Field of the Invention

The present invention generally relates to the art of electrical switches and, more particularly, to an electrical switch used in a mobile phone or a camera.

2. Background of the Invention

Modern mobile phones or cameras are developing rapidly, and volumes thereof are reducing gradually. As a result, amount of components used therein should be reduced for catering for the requirement.

Modern mobile phones are integrated with taking-picture function and MP3-playback function. Generally, more components are needed to realize those functions. However, the cubage of a mobile phone is too limited to accommodate more components. Providing one component with several functions is one way to satisfy the requirement.

Electrical switches are widely used in mobile phones and digital cameras. There is a heretofore unaddressed need in the industry to provide the switches with different functions.

SUMMARY OF THE INVENTION

In a preferred embodiment of the present invention, an electrical switch includes an insulative housing, a set of fixed contacts fastened in the housing, a movable contacts received in the housing, a load plate mounted above the movable contacts, a spring mounted in the load plate, a driver defined on the load plate, a shell surrounding the housing, a knob assembled with the load plate, and a push button assembled on the load plate. While rotating the knob, the load plate is accordingly rotated, and the movable contacts are driven to contact with some of the fixed contacts, which enables rotary operation. While pressing the push button, the driver is pressed to move downwardly to press the movable contacts for contacting with the fixed contacts, which enables pushing operation.

Other features and advantages of the present invention will become more apparent to those skilled in the art upon examination of the following drawings and detailed description of preferred embodiment, in which:

DETAILED DESCRIPTION OF THE PREFERRED EMBODIMENT

Reference will now be made to describe the preferred embodiment of the present invention in detail.

Figure 1:
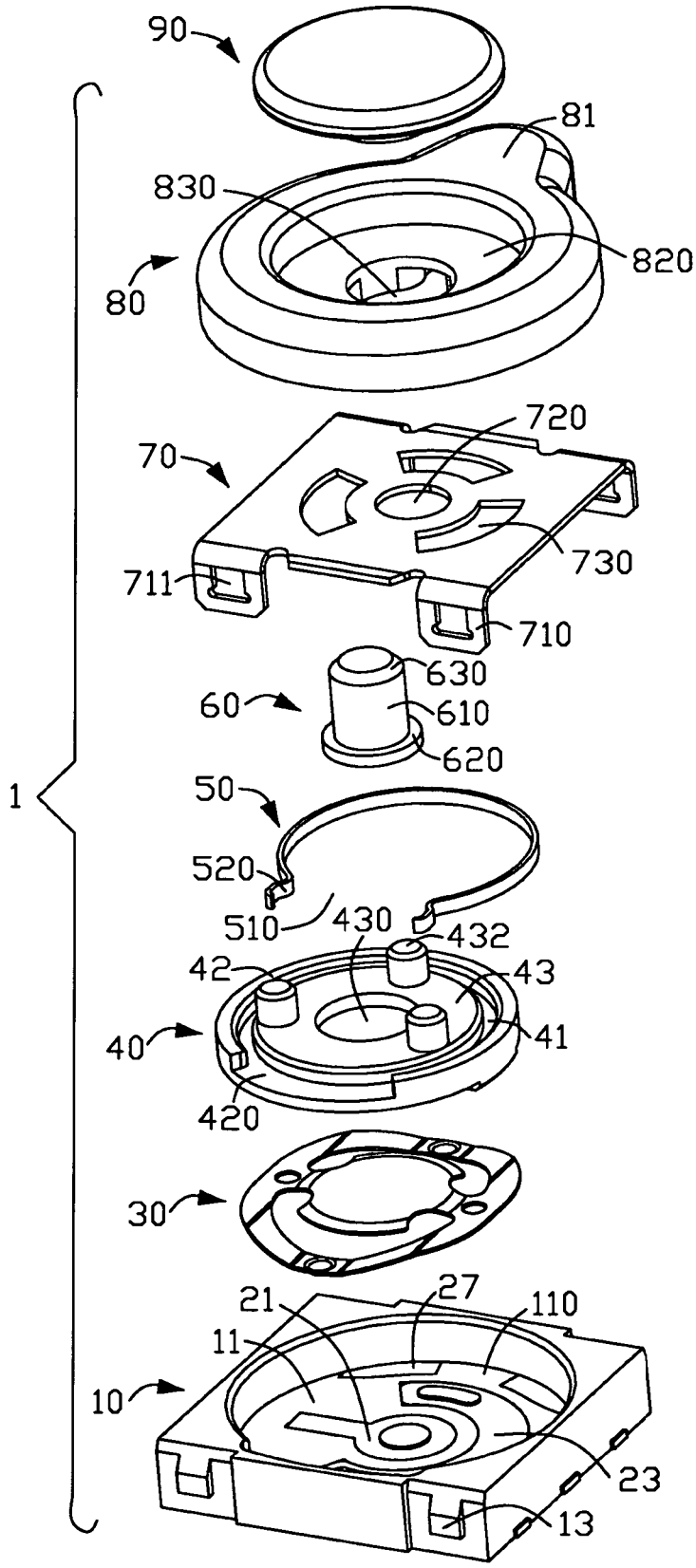
FIG. 1 depicts an exploded, isometric view of an electrical switch in accordance with a preferred embodiment of the present invention.
Figure 2:
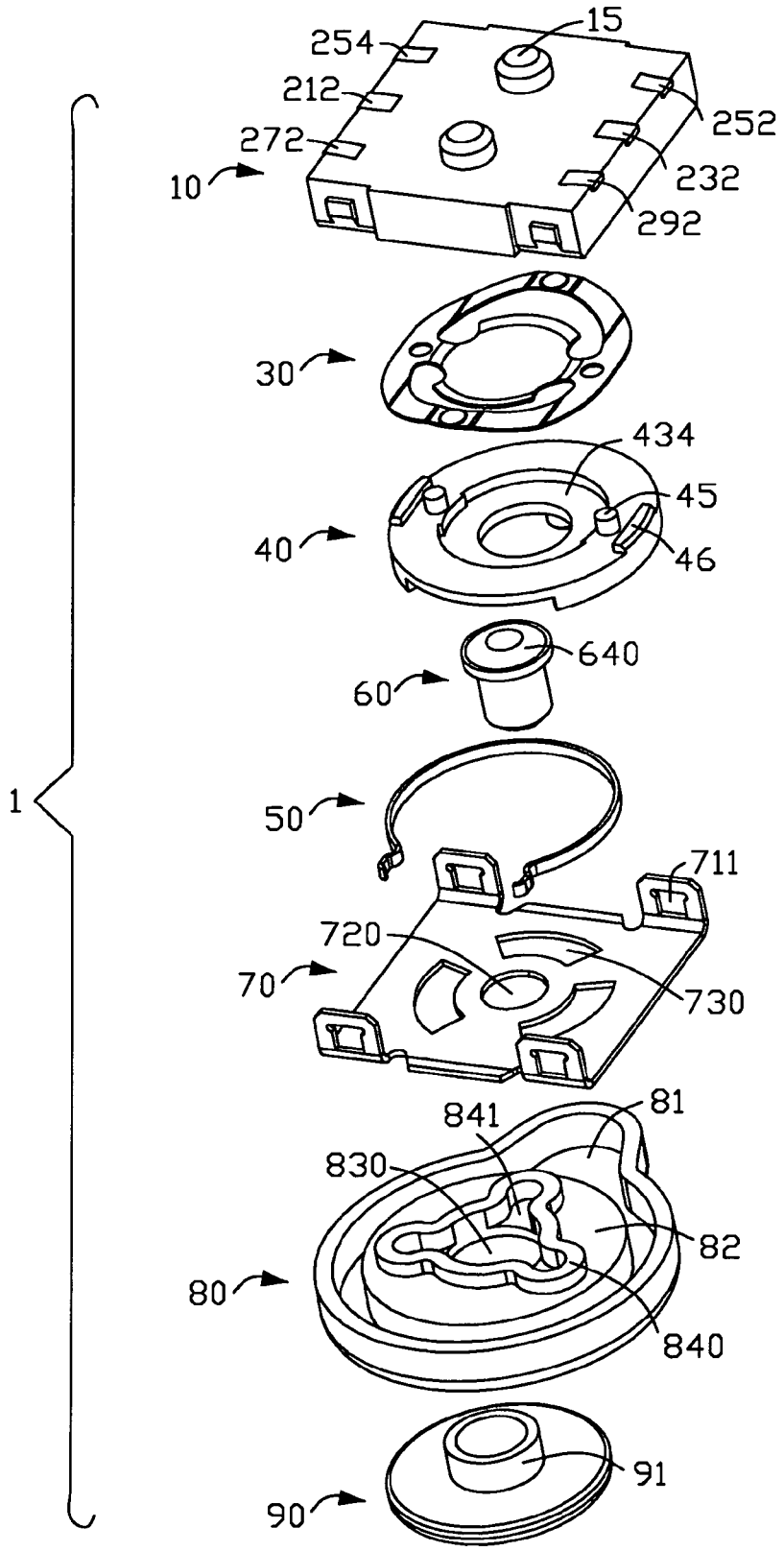
FIG. 2 depicts an exploded view of the switch of FIG. 1, from another aspect.
Figure 3:
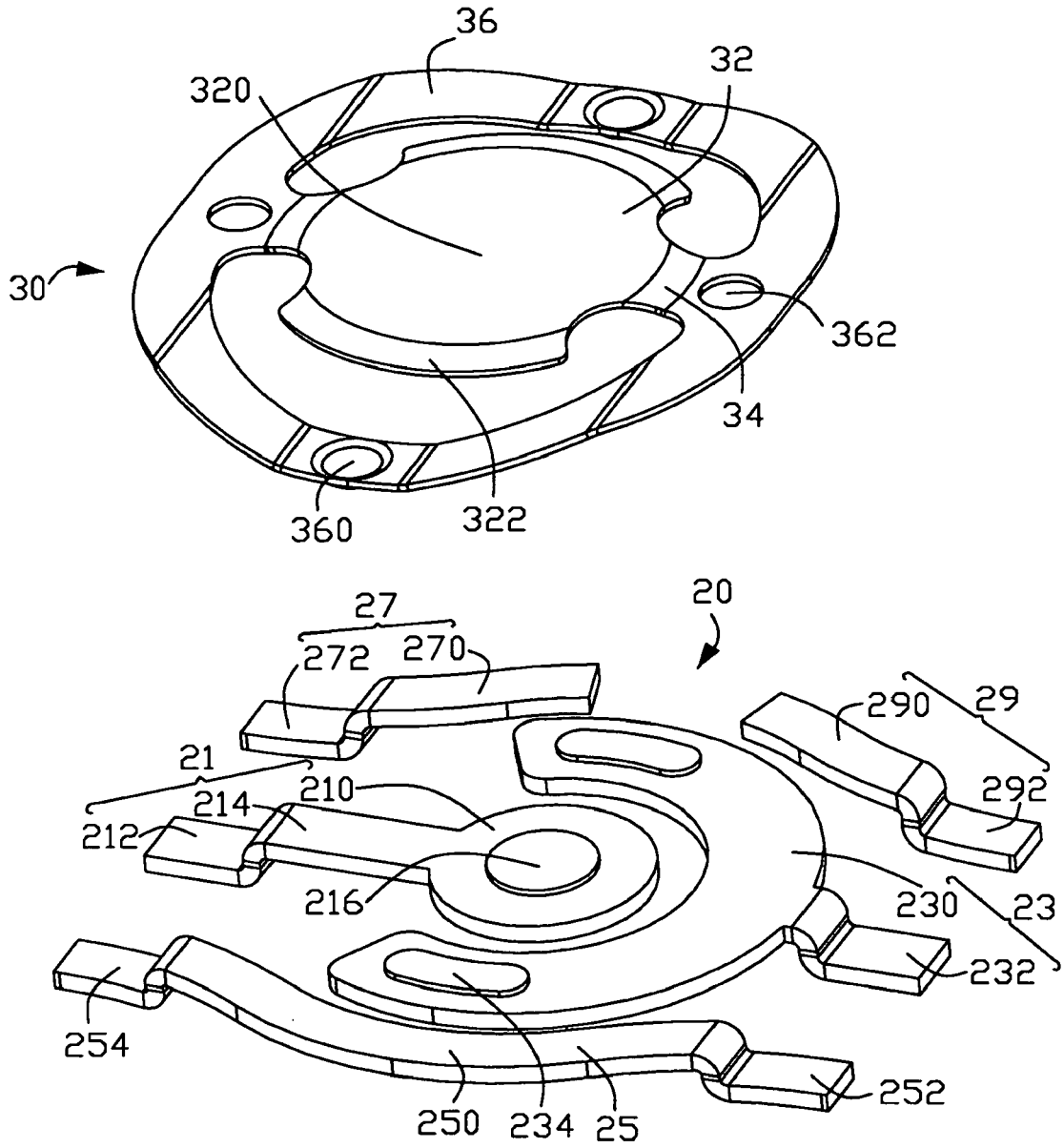
FIG. 3 depicts an enlarged view of a movable contact and fixed contacts in the switch.
Figure 4:
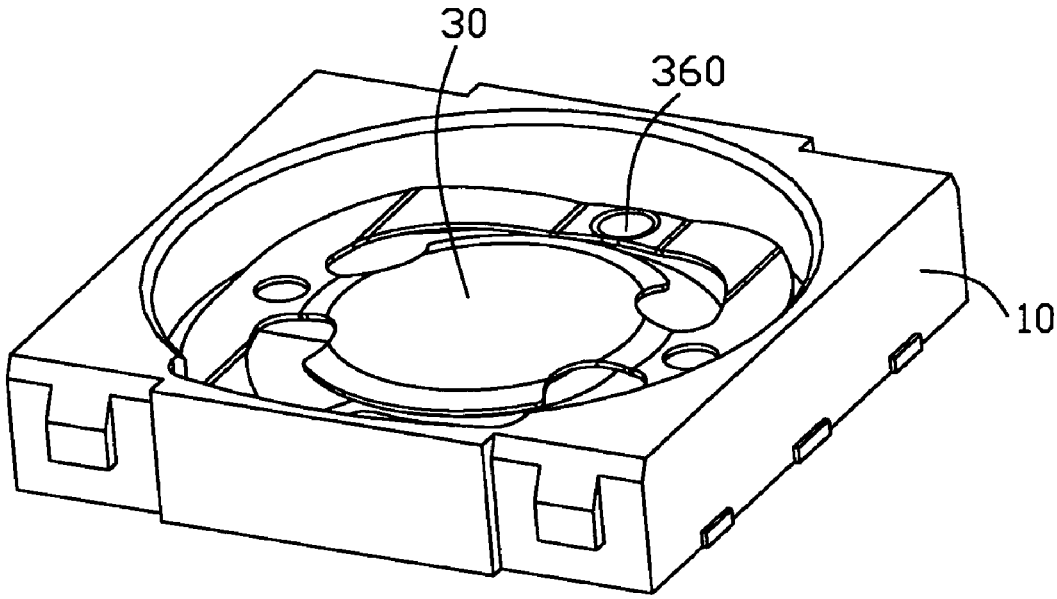
FIG. 4 depicts an enlarged isometric view of an insulative housing, a set of fixed contacts and the movable contact of the switch.
Figure 5:
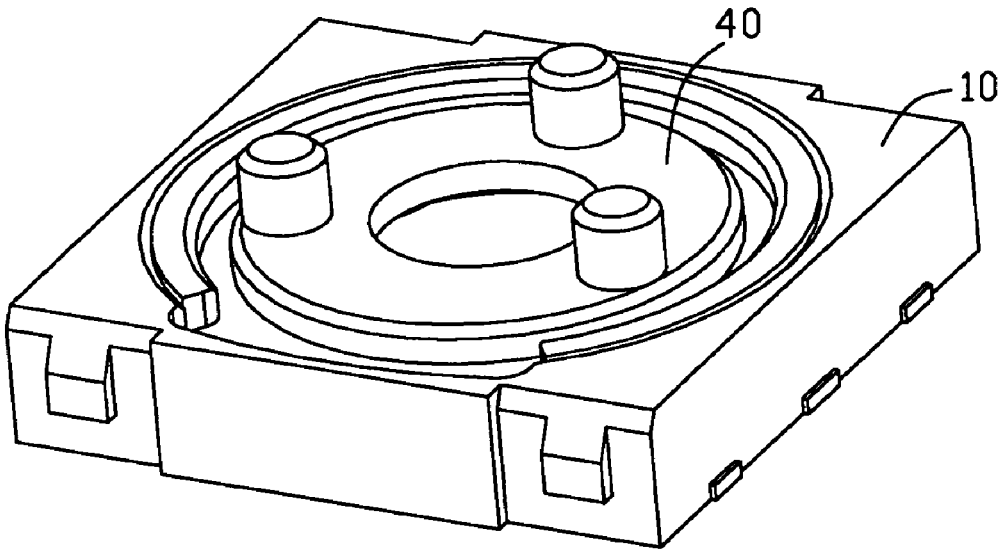
FIG. 5 is an assembled view of FIG. 4, shown with a load plate in FIG. 1.
Figure 6:
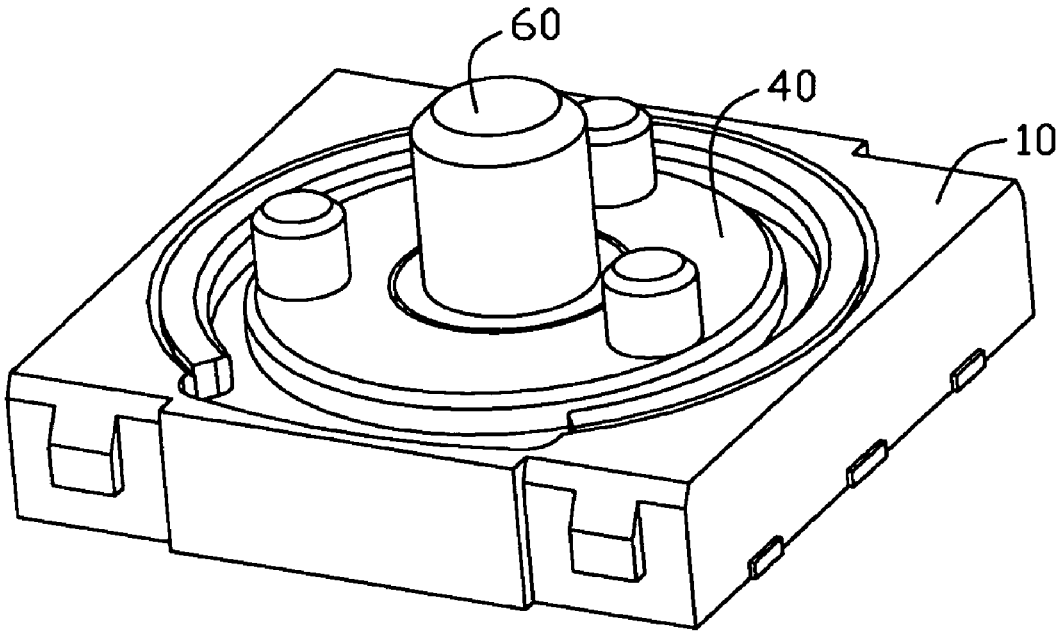
FIG. 6 is an assembled view of FIG. 5, shown with a driver in FIG. 1.
Figure 7:
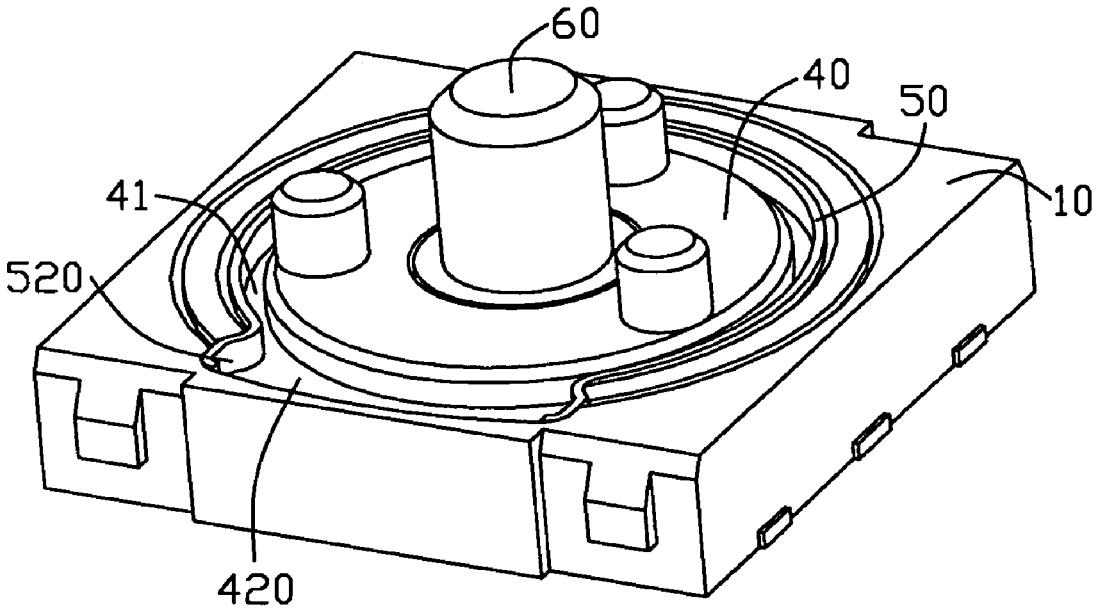
FIG. 7 is an assembled view of FIG. 6, shown with a spring in FIG. 1.
Figure 8:
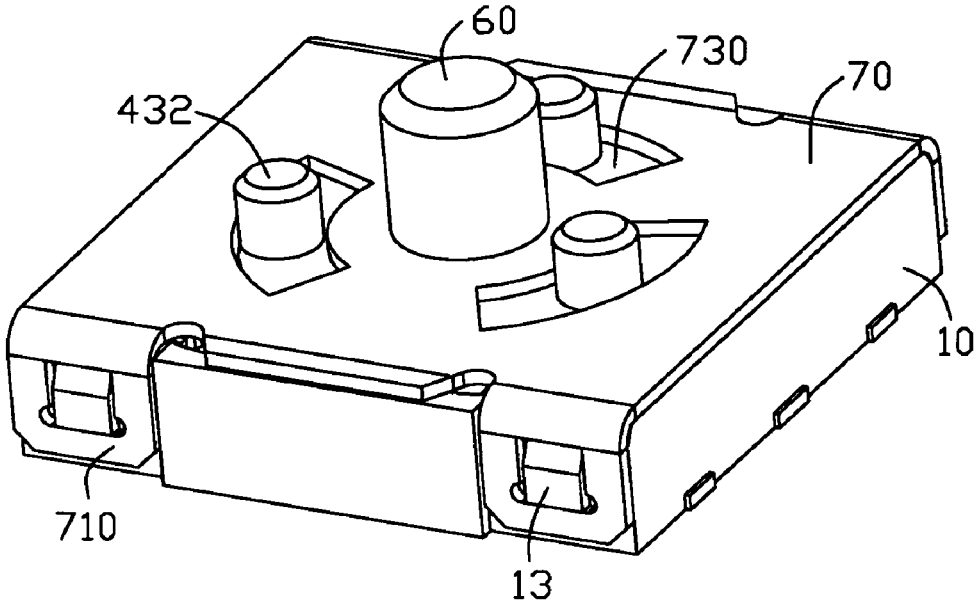
FIG. 8 is an assembled view of FIG. 7, shown with a shell in FIG. 1.
Figure 9:
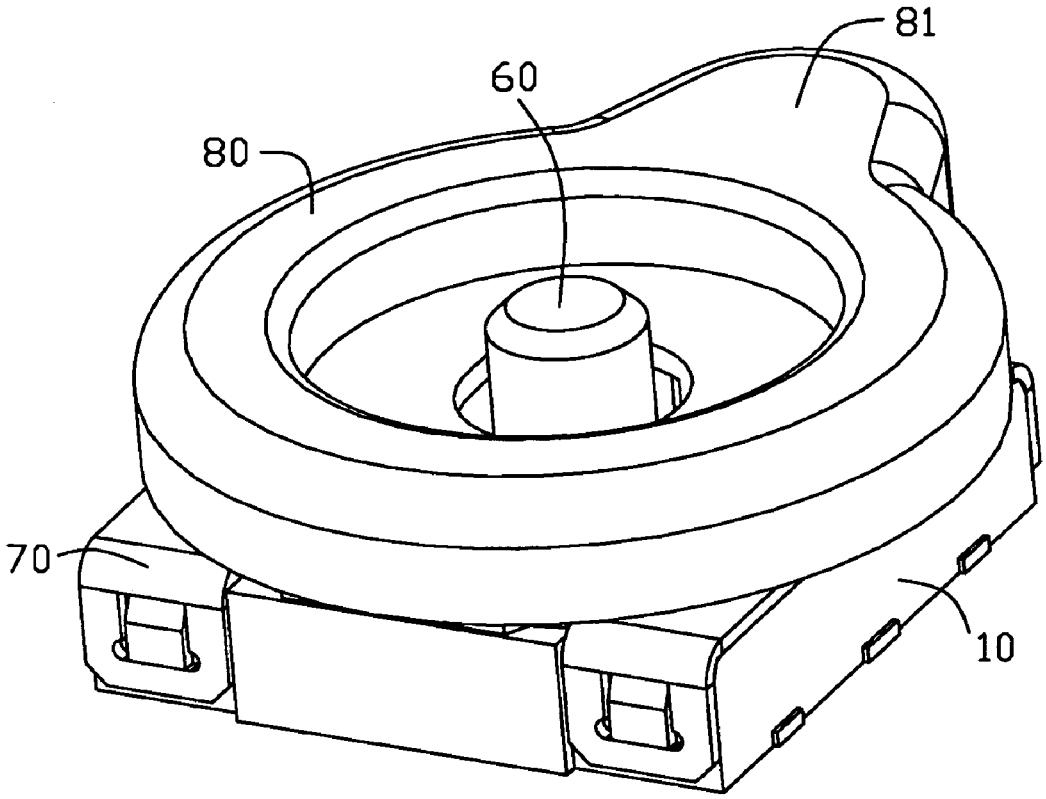
FIG. 9 is an assembled view of FIG. 8, shown with a knob in FIG. 1.
Figure 10:
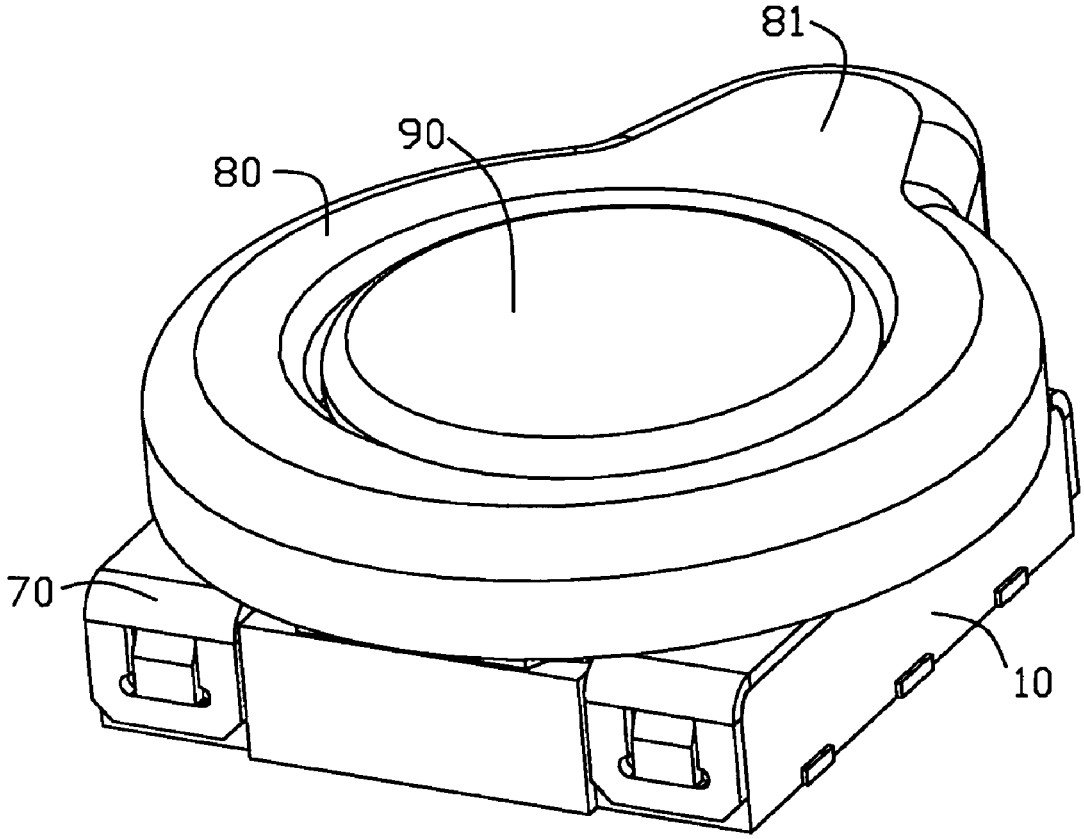
FIG. 10 is an assembled view of the switch of the present invention.

Referring to FIGS. 1–3, an electrical switch in accordance with a preferred embodiment of the present invention includes an insulative housing 10, a set of fixed contacts 20 embedded in the housing 10, movable contacts 30, load plate 40, spring 50, driver 60, shell 70, knob 80 and a pushing button 90.

The insulative housing is rectangular shaped, and defines an opening 11, a plurality of blocks 13, and a pair of posts 15.

The set of fixed contacts 20 includes a first contact 21, a second contact 23, a third contact 25, a fourth contact 27, and a fifth contact 29. The first contact 21 includes a circular head portion 210, a first tail portion 212, and a linking portion 214 connecting the head portion 210 with the first tail portion 212. The head portion 210 defines a first contacting portion 216 in a middle portion thereof.

The second contact 23 is fork-like and includes an U-shaped portion 230 and a second tail portion extending from a middle portion of the U-shaped portion 230. The U-shaped portion defines a second contacting portion 234 at two ends thereof, respectively.

The third contact 25 includes a beam 250, and a pair of third tail portions 252, 254 extending from two ends of the beam 250.

The fourth contact 27 is similar to the fifth contact 29. The fourth contact 27 defines a first arm 270 and a fourth tail portion 272. Similarly, the fifth contact 29 defines a second arm 290, and a fifth tail portion 292.

The set of fixed contacts 20 are embedded in the opening 11 and partially disposed out of the opening 11.

The movable contact 30 includes a central part 32, and a side 36 surrounding the central part 32. The side 36 connects with the central part 32 via a linking portion 34. The central part 32 is vaulted. In a free status, a middle portion thereof is highest. Accordingly, the central part 32 defines a top portion 320 and a peripheral portion 322. The side 36 defines a pair of sunken portions 360 as a contacting portion. A pair of through-holes 362 is defined in the side 36.

The load plate 40 defines a slot 41. Accordingly, the load plate further defines a sidewall 42 and an island 43. The sidewall 42 is not closed and defines a cut 420. The island 43 defines an aperture 430 in a middle portion thereof. In addition, three sliders 432 are equably arranged on the island 43. Referring to FIG. 2, the load plate 40 defines a receiving space 434 corresponding to the island 43, a first protrusion 45, and a second protrusion 46. It's noted that a diameter of the first protrusion 45 is smaller than that of the through-hole 362.

The spring 50 is an unclosed circle strip, and defines a placket 510. The spring 50 further defines a pair of fastening portions 520 at ends of the strip. The driver 60 defines a main body 610, and a step 620 having a greater diameter than the main body 610. The step 620 defines a bevel 630 at a top portion thereof. A diameter of the step is smaller than that of the aperture 430.

The shell 70 defines four bending portions 710, each bending portion defining a window 711. In a middle portion, the shell defines a bore 720 corresponding to the driver 60. The shell 70 further defines three hatches 730 corresponding to the sliders 432. The knob 80 defines an acting portion 81, and a recessed area 820 in a middle portion thereof. The recessed area 820 forms a bottom wall 82. The bottom wall 82 defines a trough 830 having a diameter greater than that of the main body 610 of the driver 60. The bottom wall 82 further defines a trigonal boarding 840, each corner of the boarding 840 defining a semicircular groove 841.

The pushing button 90 is circular and defines a pillar 91 having a diameter substantially equal to that of the main body 610 of the driver 60.

Referring to FIGS. 4–12, while the electrical switch 1 is assembled, the movable contacts 30 are positioned in the opening 11, with one sunken portion 360 abutting against a middle portion of the beam 250 of the third contact 25. At the same time, another sunken portion 360 abuts against an insulative portion between the fourth contact 27 and the fifth contact 29. The load plate 40 is also positioned in the opening 11, with two first protrusions 45 cooperating with the corresponding through-holes 362. The driver 60 is placed in the aperture 430 of the load plate 40, with a portion abutting against the top portion 320 of the movable contact 30. The spring 50 is assembled in slot 41 of the load plate 40, with the placket 510 aligning with the cut 420 of the load plate 40.

The shell 70 covers on the insulative housing 10. The main body 610 of the driver 60 is partially received in the bore 720 of the shell. The sliders 432 drill through the hatches 730.

The knob 80 is positioned above the shell 70, with the trough 830 thereof receiving the main body 610 of the driver 60. The sliders 432 are received in the semicircular grooves 841 for positioning the knob 80. The pushing button 90 is positioned in the recessed area 820, with the pillar 91 wrapping the main body 610 of the driver 60.

Figure 11:
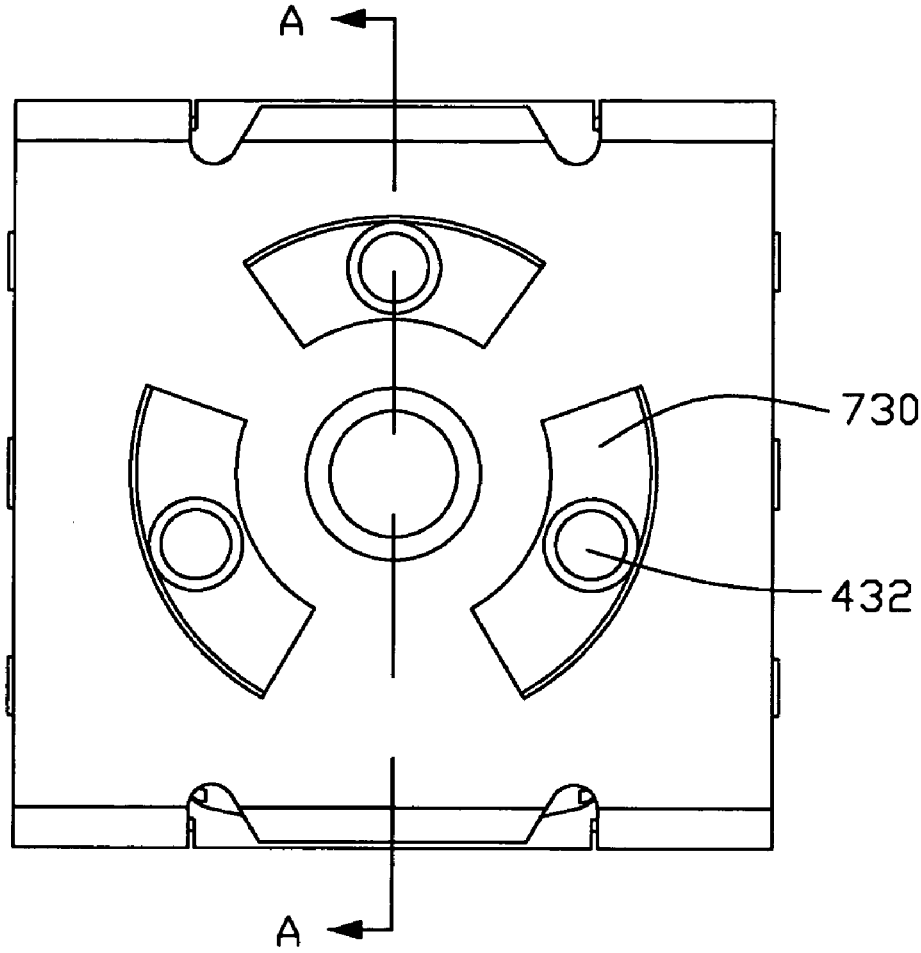
FIG. 11 is a top view of the assembly in FIG. 8.
Figure 12:
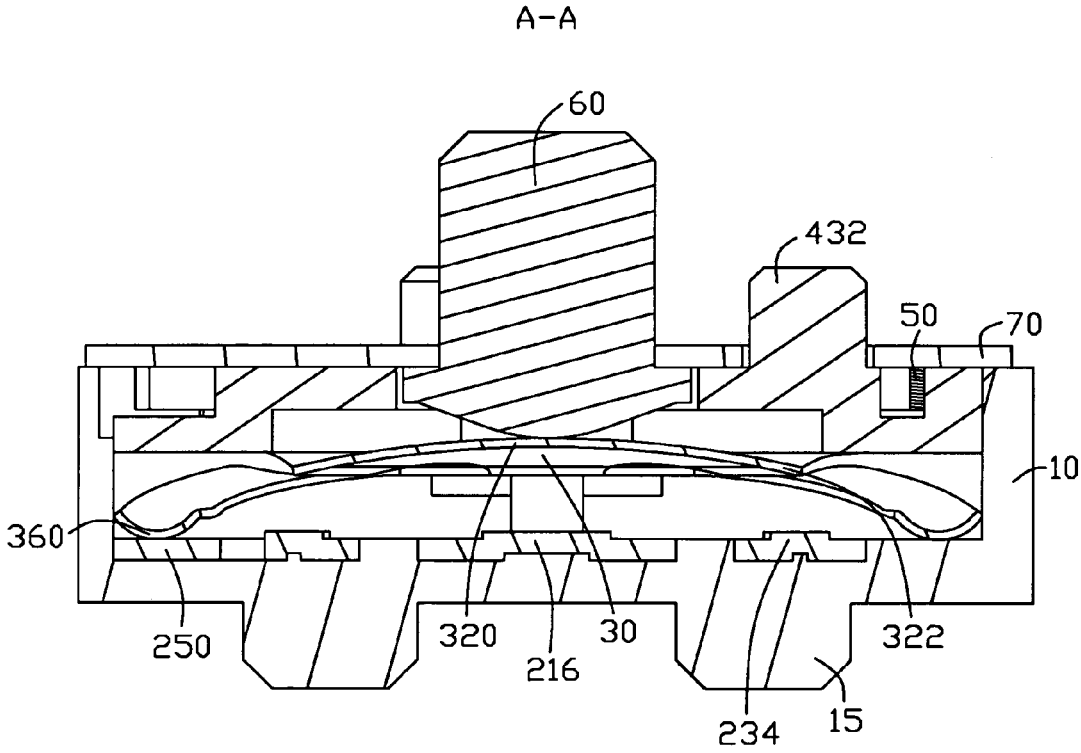
FIG. 12 is a cross-sectional view of FIG. 11 along Line A—A.
Figure 13:
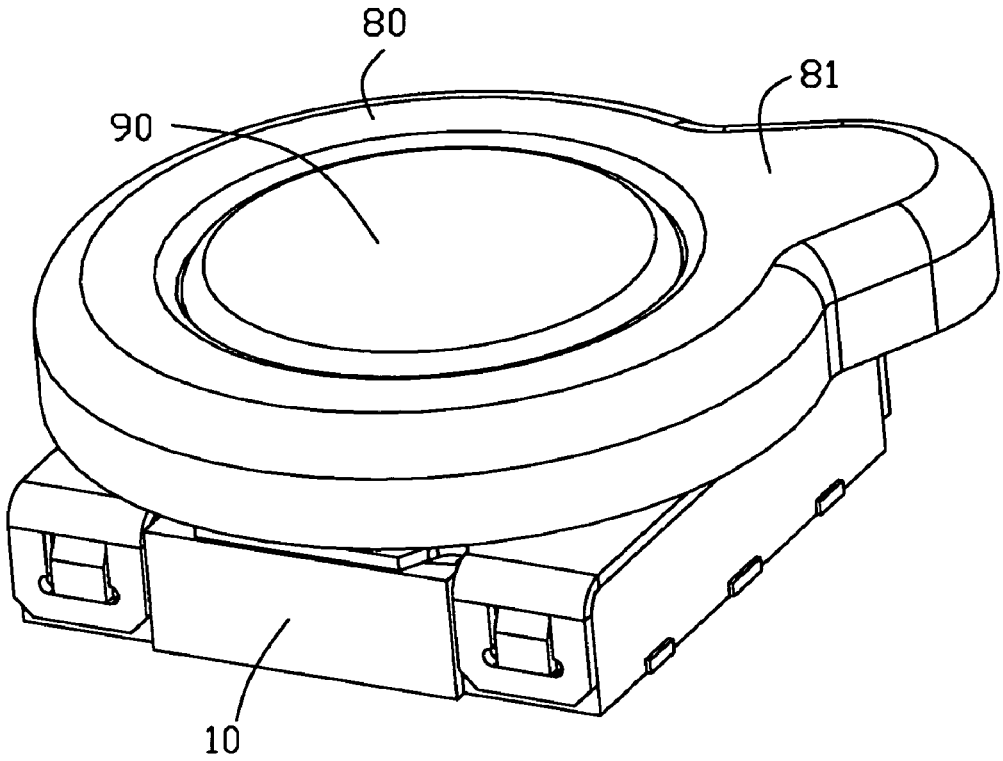
FIG. 13 is similar to FIG. 10, showing the knob at a clockwise operation position.
Figure 14:
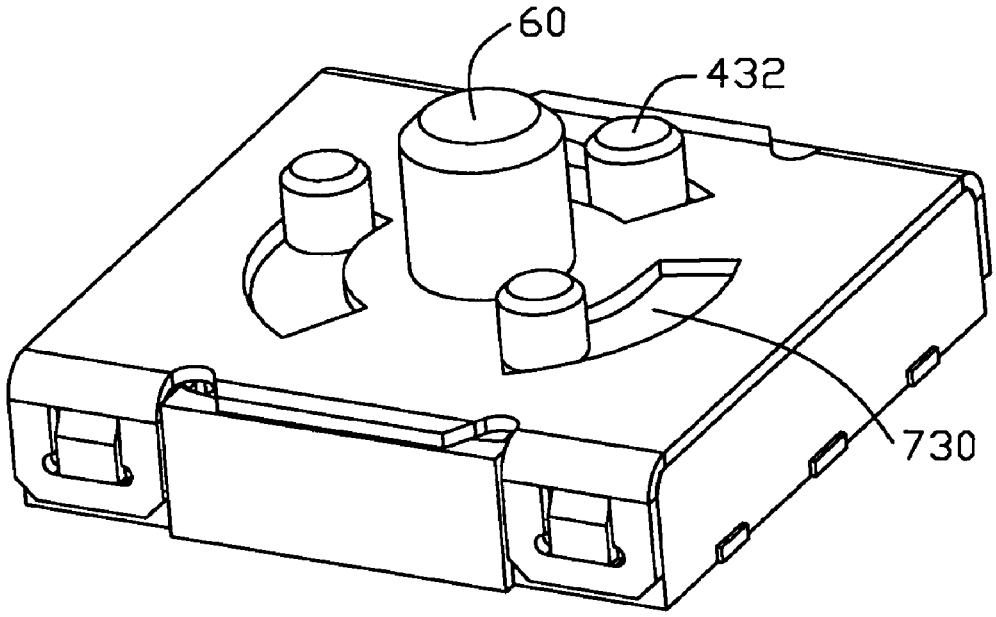
FIG. 14 is similar to FIG. 8, showing the load plate at a clockwise operation position.
Figure 15:
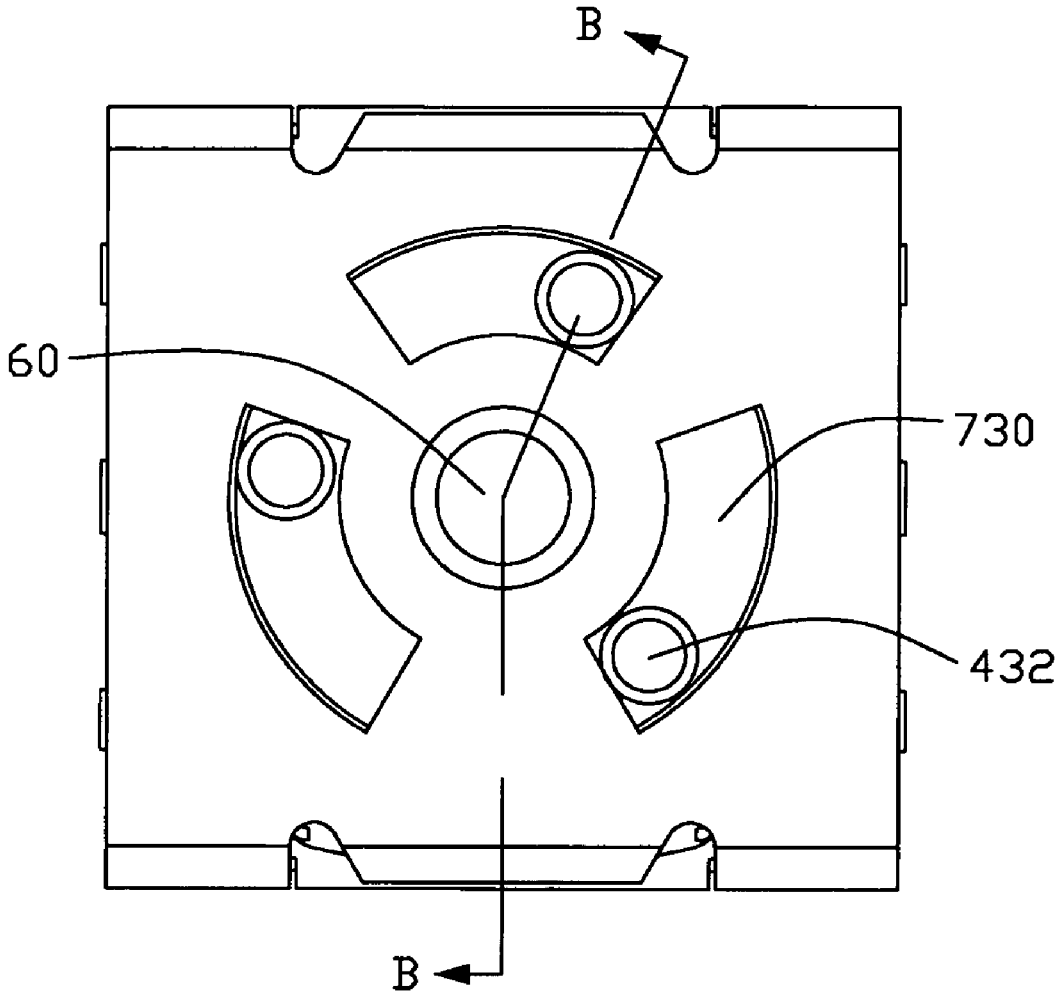
FIG. 15 is a top view of the assembly in FIG. 14.
Figure 16:
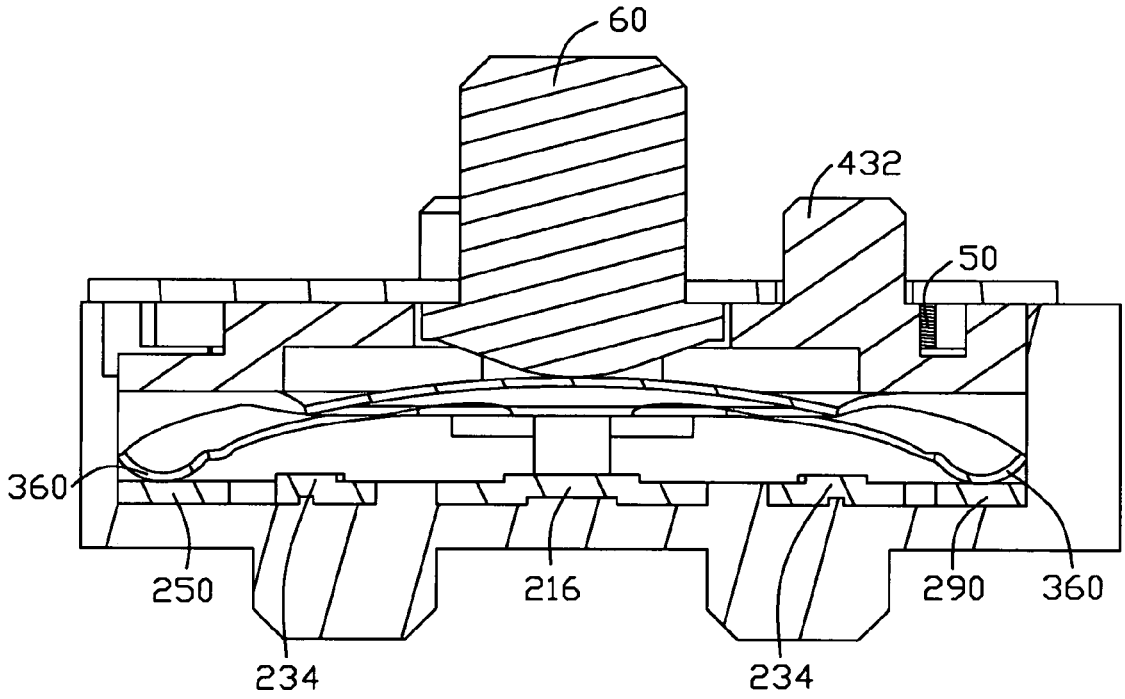
FIG. 16 is a cross-sectional view of FIG. 15 along Line B—B.
Figure 17:
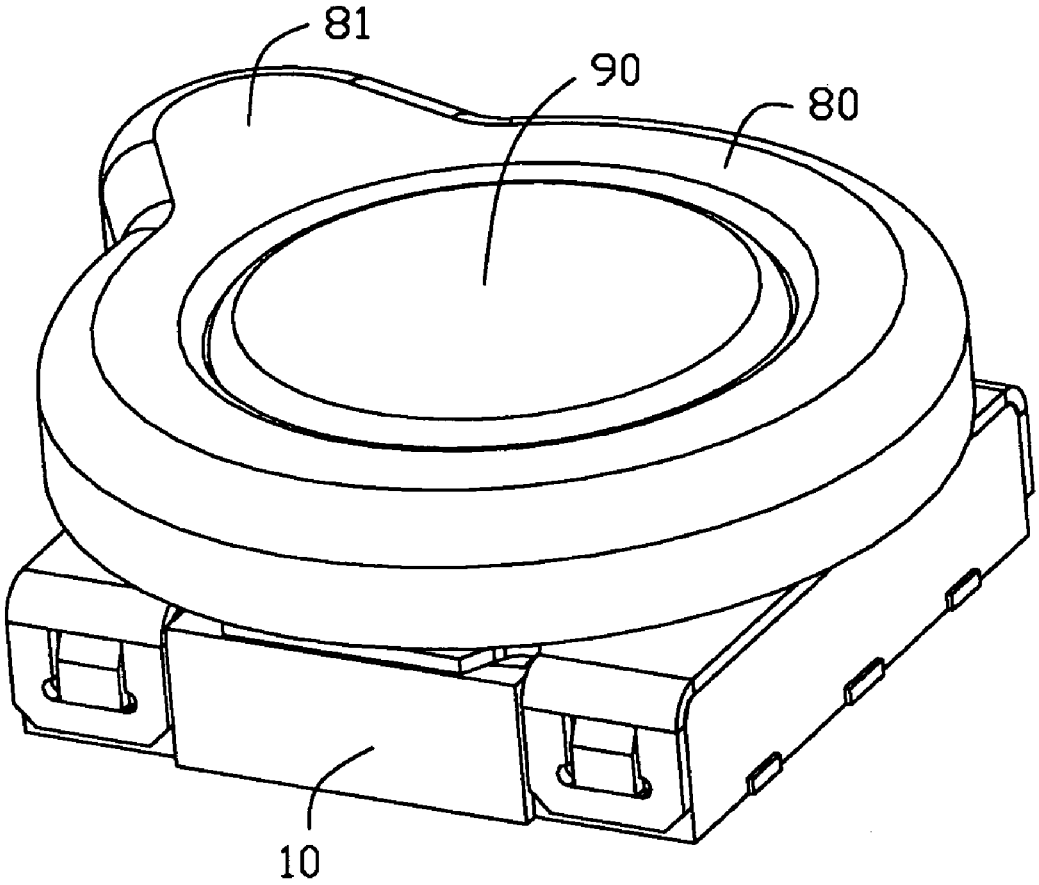
FIG. 17 is similar to FIG. 10, showing the knob at a counterclockwise operation position.
Figure 18:
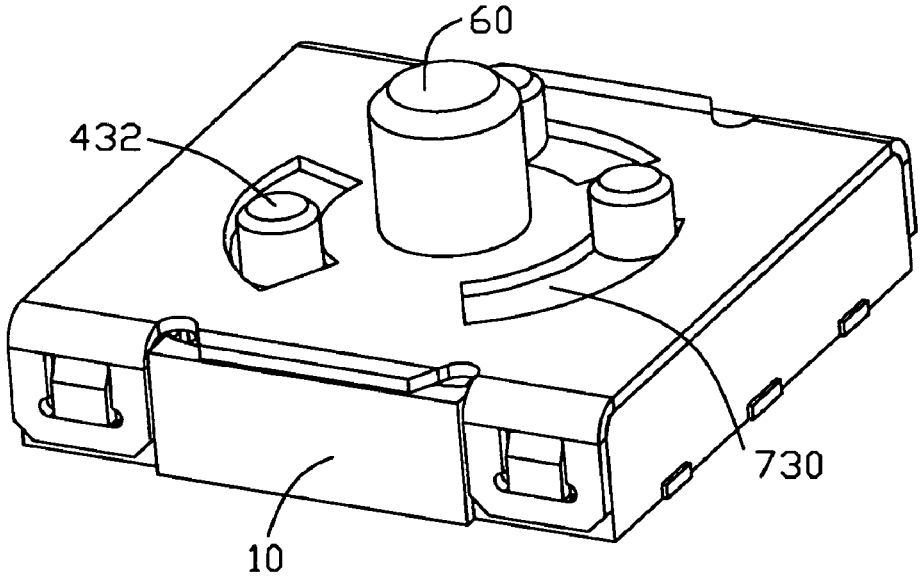
FIG. 18 is similar to FIG. 8, showing the load plate at a counterclockwise operation position.
Figure 19:
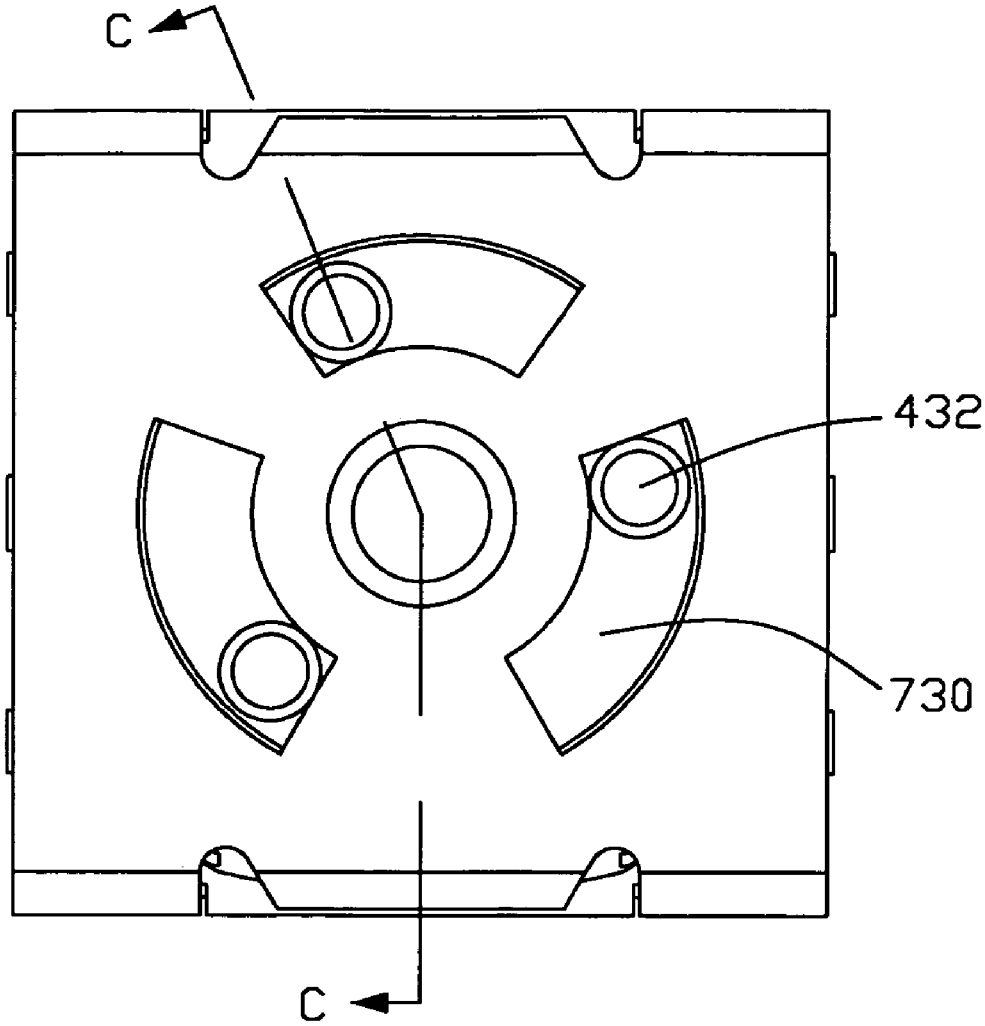
FIG. 19 is a top view of the assembly in FIG. 18.
Figure 20:
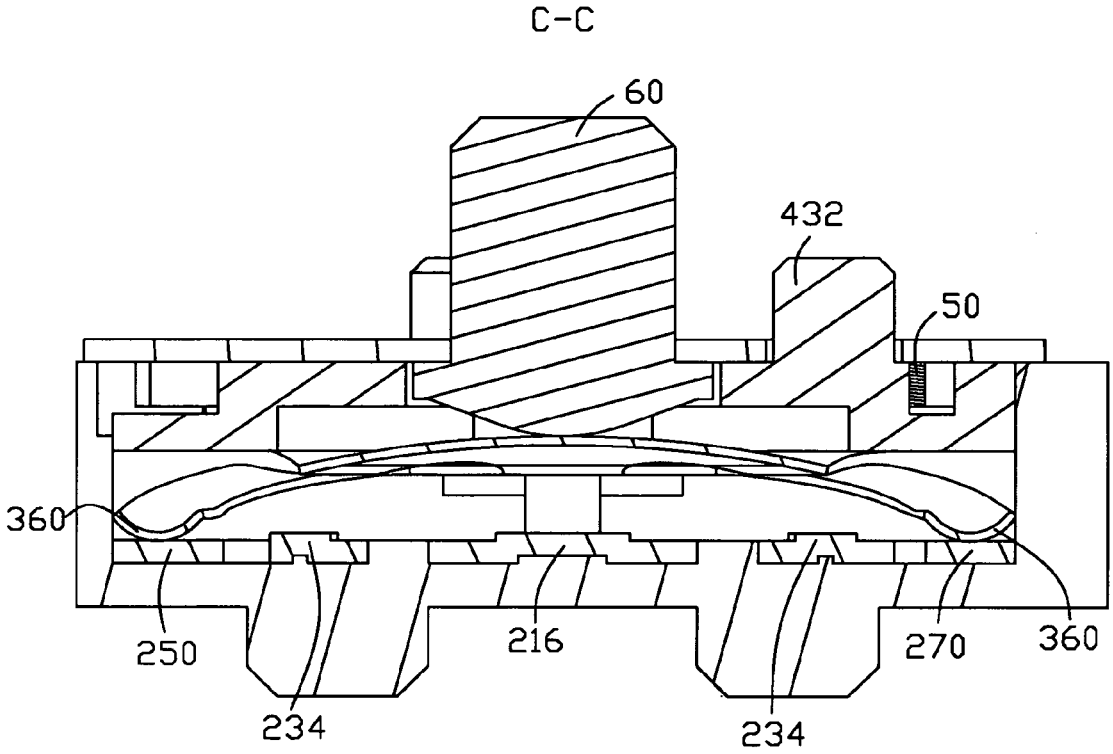
FIG. 20 is a cross-sectional view of FIG. 19 along Line C—C.

Referring to FIGS. 11–12, while the switch 1 is free, the sliders 432 are positioned in middle portions of the hatches 730, and the spring 50 is not suppressed. When the pushing button 90 is pressed, the driver 60 is accordingly actuated to move downwardly, which enables the central part 32 of the movable contact 30 to be transformed elastically for contacting with the first contacting portion 216. The peripheral portion 322 is accordingly actuated to contact with the second contacting portion 234 of the second contact 23. Therefore, pushing operation is realized.

Referring to FIGS. 13–16, while the acting portion 81 is rotated clockwise, the sliders 432 of the load plate 40 are actuated to move clockwise along the hatches 730. The movement of the load plate 40 actuates the movable contact 30 to rotate clockwise till the sunken portion 360 contacts with the second arm 290 of the fifth contact 29. Therefore, rotary operation is realized.

FIGS. 17–20 show the operating process while the knob 80 is rotated counterclockwise. The process is similar to that shown in FIGS. 13–16. What is different is that the sunken portion 360 contacts with the third contact 25 or the fourth contact 27.

While the present invention has been described with reference to a specific embodiment, the description of the invention is illustrative and is not to be construed as limiting the invention. Various of modifications to the present invention can be made to the preferred embodiment by those skilled in the art without departing from the true spirit and scope of the invention as defined by the appended claims.

What is claimed is:

1. An electrical switch comprising:

an insulative housing having an opening;

a set of fixed contacts embedded in the housing;

a movable contact received in the opening;

a shell covering the opening;

a load plate positioned in the opening for cooperating with the movable contact;

a spring assembled with the load plate;

a driver drilling through the load plate and abutting against the movable contact; and a knob; wherein while the driver is pressed, the movable contact is elastically deformed for contacting with the fixed contacts, and while the knob is rotated, the load plate actuates the movable contact to contact with the fixed contacts.

2. The electrical switch as described in claim 1, wherein the insulative housing defines a plurality of blocks, and the shell defines a plurality of windows for cooperating with the blocks for assembling the shell with the housing.

3. The electrical switch as described in claim 1, wherein the set of fixed contacts includes:

a first contact having a circular head portion, a first tail portion, and a linking portion connecting the head portion with the first tail portion;

a second contact including an U-shaped portion and a second tail portion extending from a middle portion of the U-shaped portion;

a third contact including a beam, and a pair of third tail portions extending from two ends of the beam;

a fourth contact being similar to the fifth contact and defining a first arm and a fourth tail portion.

4. The electrical switch as described in claim 3, wherein the movable contact includes a central part, and a side surrounding the central part, the side connecting with the central part.

5. The electrical switch as described in claim 4, wherein the central part defines a top portion and a peripheral portion, and the side defines a pair of sunken portions as a contacting portion.

6. The electrical switch as described in claim 5, wherein the load plate defines a slot, a sidewall defining a cut, and an island defining an aperture in a middle portion thereof and a plurality of sliders.

7. The electrical switch as described in claim 6, wherein the driver defines a main body defining a bevel at a top portion thereof.

8. The electrical switch as described in claim 7, wherein the knob defines an acting portion, and a recessed area forming a bottom wall, the bottom wall defining a trough having a diameter greater than that of the main body of the driver, the bottom wall further defining a trigonal boarding, each corner of the boarding defining a semicircular groove.

9. The electrical switch as described in claim 8 further including a pushing button having a pillar having a diameter substantially equal to that of the main body of the driver.

10. An electrical switch comprising:

an insulative housing having a receiving cavity therein;

a set of fixed contacts disposed to the housing;

a deflectable contact moveable within said receiving cavity;

a load plate engageable with and cooperating with the deflectable contact;

a spring positioned about the load plate and constantly urging the load plate to be in an initial position relative to a rotation position;

a first actuation device actuating the deflectable contact vertically so as to have the deflectable contact engage at least one of said fixed contacts; and a second actuation device actuating at least one of said load plate and said deflectable contact to rotate abut an axis which extends vertically so as to have the deflectable contact engage at least another one of said fixed contacts.

11. The switch as claimed in claim 10, wherein said load plate and said deflectable contact are associatively secured to each other, and are rotated together by said second actuation device.

12. The switch as claimed in claim 10, wherein the second actuation device is fixed to the load plate.

13. The switch as claimed in claim 10, wherein restoration force of rotation is derived from the spring while restoration force of vertical movement is derived from the deflectable contact.

14. The switch as claimed in claim 10, wherein vertical movement of the deflectable contact results in electrical connection between the fixed contacts in a central region of said set of fixed contacts while rotation movement of the deflectable contact results in electrical connection between fixed contacts in a peripheral region of said set of fixed contacts.

15. The switch as claimed in claim 10, wherein a center portion of said deflectable contact is up-and-down moveable relative to a periphery of said deflectable contact while the periphery of said deflectable contact extends itself along a corresponding circumference in an up-and-down manner.

16. The switch as claimed in claim 10, wherein said second actuation device essentially surrounds said first actuation device.

17. An electrical switch comprising:

an insulative housing having a receiving cavity therein;

a set of fixed contacts disposed to the housing;

a deflectable contact moveable within said receiving cavity;

a load plate engageable with and cooperating with the deflectable contact;

a first actuation device actuating the moveable contact vertically so as to have the deflectable contact engage at least one of said fixed contacts; and a second actuation device actuating at least one of said load plate and said deflectable contact to rotate abut an axis which extends vertically so as to have the deflectable contact engage at least another one of said fixed contacts; wherein said deflectable contact defines a central portion and a periphery under a condition that the central portion is up-and-down moveable relative to the periphery while the periphery is up-and-down curved along a circumference thereof.

18. The switch as claimed in claim 17, wherein said one of the fixed contacts is located in a central region while said another of the fixed contacts is located in a peripheral region.

* * * * *